United States Patent [19]

Appelbaum

[11] Patent Number: 4,869,082

[45] Date of Patent: Sep. 26, 1989

[54] PADLOCK COVER WITH STORAGE COMPARTMENT

[76] Inventor: Paul Appelbaum, P.O. Box 27006, Denver, Colo. 80227

[21] Appl. No.: 183,909

[22] Filed: Apr. 20, 1988

[51] Int. Cl.[4] ..... E05B 67/53

[52] U.S. Cl. ..... 70/63; 206/1.5; 220/350; 70/55; 70/56; 70/54; 70/52

[58] Field of Search ..... 220/315, 350; 206/1.5; 70/54, 55, 56, 52, 63

[56] References Cited

U.S. PATENT DOCUMENTS 4,576,022 3/1986 Gamble ..... 70/55

4,718,259 1/1988 Applebaum ..... 70/55

*Primary Examiner*—Stephen Marcus

*Assistant Examiner*—Gilbert Reece

*Attorney, Agent, or Firm*—Charles C. Corbin

[57] ABSTRACT

A padlock cover with storage compartment, having a first portion which covers the case of a conventional padlock, this first portion having a pair of openings for passing the legs of the padlock shackle. The cover has a second portion having spaced apart walls that define a storage compartment, with an access opening in one wall. A flexible, resilient, elongated lid member is mounted in guide means such that it has a closed position in which one end portion covers the storage compartment opening and the other end abuts the releasably locked leg of the shackle to hold the lid closed; and the lid member being slidable to an open position in which the compartment opening is uncovered when the shackle leg is released from the padlock case thereby unobstructing further guided movement of the lid.

7 Claims, 2 Drawing Sheets

15a
39a
37a
23
25
19
19
51a
25
29a
30
31
27
17
33
35
13
24
20
39b
37b
21
51b
26
29b
15b

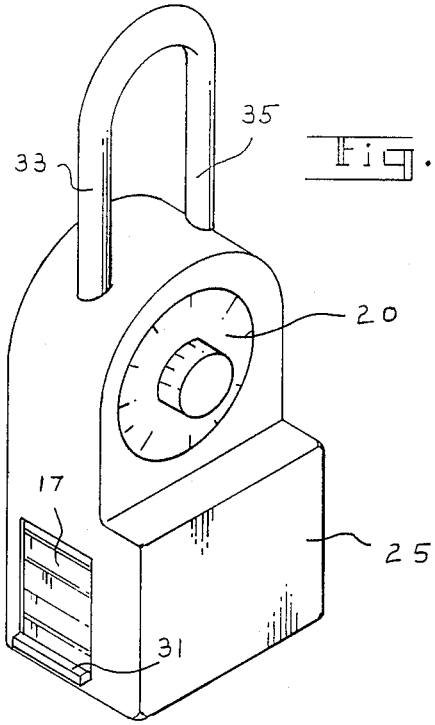
Fig. 2
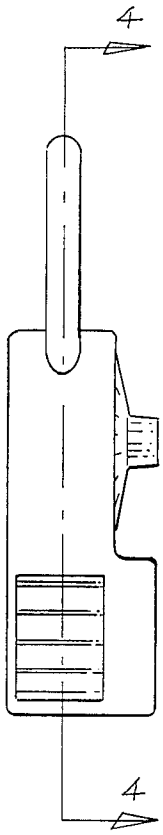
Fig. 3
Fig. 4
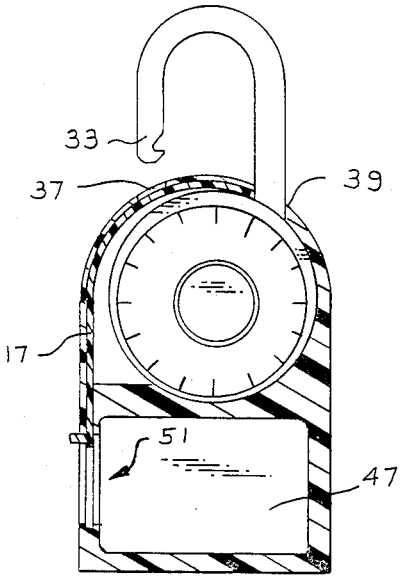
Fig. 5
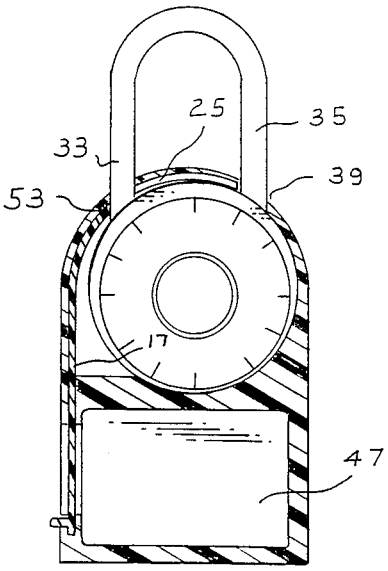

PADLOCK COVER WITH STORAGE COMPARTMENT

BACKGROUND

The present invention relates generally to a protective cover for a padlock case, and more particularly to a padlock cover that includes a lockable storage compartment.

There is a need for a protective cover for a padlock that is simple, inexpensive, and potentially decorative. The present invention provides these things, and in addition has an integral storage compartment with a lid that can be slid open when the padlock is open and that can be locked closed when the padlock is locked. As an additional advantage the padlock can only be locked when the storage compartment lid is closed.

SUMMARY OF THE INVENTION

Accordingly the present invention provides a cover for use with a conventional padlock having a U-shaped shackle with a first shackle leg that is releasably received in the padlock case, the cover having a first compartment for mounting and covering the padlock case and having a pair of openings for passing the padlock shackle with a first opening for the first shackle leg. The invention includes a second compartment adjoining the first one, and which has spaced apart walls that define a storage space, with an access opening in one wall thereof. The inventive cover features an elongated lid member slidably mounted in guide means, which means extends from the storage compartment opening past the vicinity of the first shackle leg opening. The lid has a closed position in which a first end portion covers the compartment opening, the lid being lockable in this position by virtue of a second end of the lid abutting the locked first leg of said shackle. When the shackle is opened and the first leg removed from the guided path of the lid, the lid may be moved so that the storage opening is uncovered. When the lid is open it obstructs passage of the first shackle leg, preventing the locking of the shackle until the lid is completely closed. Additional advantages and novel features of the present invention will be apparent upon a reading of the detailed description and claims which follow.

BRIEF DESCRIPTION OF DRAWINGS

FIG. 2 is an isometric view of a padlock cover according to the invention;

FIG. 3 is a side elevational view of the padlock cover of the invention;

FIG. 4 is a sectional view taken along the line 4—4 of FIG. 3; and

FIG. 5 is a sectional view similar to FIG. 4.

DETAILED DESCRIPTION

Figure 1:
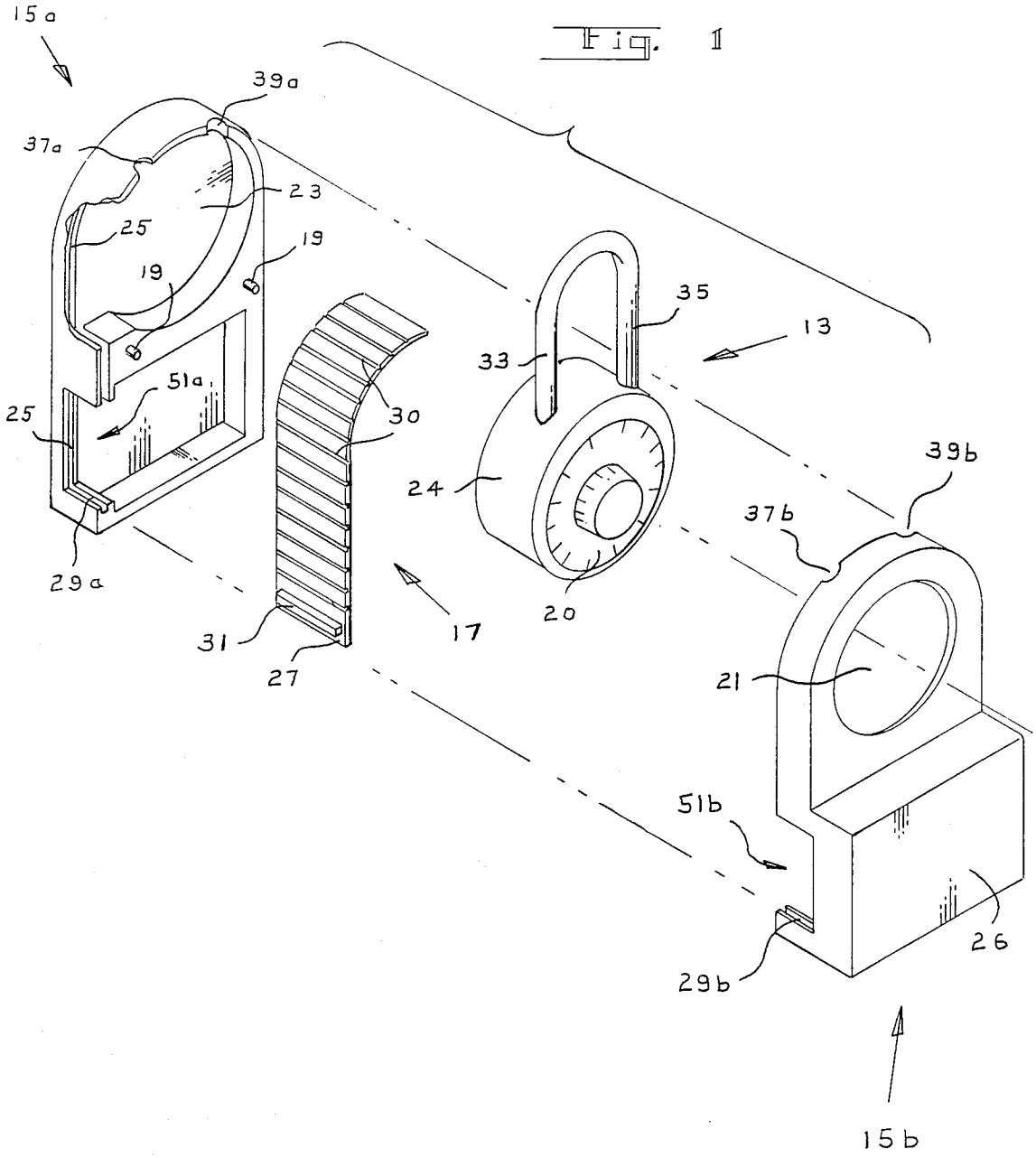
FIG. 1 is an exploded view, with parts broken away, illustrating the inventive padlock cover with storage compartment.

Referring now to the drawings, FIG. 1 shows that the novel cover for the padlock 13 comprises the first and second cover halves 15*a* and 15*b*, and an elongated, flexible and resilient lid 17, which components are preferably molded in a suitable polymeric material.

The upper portion of part 15*a* , has a cylindrical depression 23 which cooperates with a corresponding depression (not shown) in part 15*b* to snugly cover and mount the cylindrical case 24 of padlock 13, when the parts 15*a* and 15*b* are mated. When this is done the semicircular slots 37*a* and 39*a* will match with semicircular slots 37*b* and 39*b* to form openings 37 and 39 for passing the legs 33 and 35 respectively of padlock 13. As FIG. 4 illustrates, in the assembled configuration it is the engagement of the non-releasable padlock leg 35 in opening 39 which holds padlock 13 against rotation in its mounting.

The lower portion of cover half 15*a* has a rectangular depression 45*a* to which corresponds preferably a somewhat larger depression (not shown) opposite the protruding portion 26 of cover half 15*b*, such that when the halves are joined there results a storage compartment 47, shown in FIGS. 4 and 5. As FIG. 4 shows it is apparent that the assembled halves will join the large rectangular slots 51*a* and 51*b* to also provide an access way 51 to the storage compartment 47. It is also noted that the opening 21 in the cover half 15*b* will provide in the assembled device access to the rotary padlock dial as shown in FIG. 2

As FIGS. 1 and 5 illustrate, there is a groove 25 in part 15*a* which extends from the base of the large rectangular slot 51*a* upwardly to a curved portion which terminates at a point adjacent the semicircular slot 39*a*. Horizontal grooves 29*a* and 29*b* reside in the lower edges of the large slots 51*a* and 51*b* respectively. With the exception of opening 21 and portion 26, the structure of half 15*a* is essentially the mirror image of the half 15*b*, with the further exception of alignment pins 19 on part 15*a* which are adapted to engage a corresponding pair of holes (not shown) in part 15*b*.

The elongated lid 17 is preferably a resilient plastic strip that is sufficiently flexible to follow a curved path. In the embodiment shown a plurality of scores 30 are provided in the outer surface of lid 17 to increase its flexibility in the direction it will curve during operation. One edge portion of lid 17 is adapted to be slidaby received in the groove 25 of part 15*a* and its other edge portion will be received in a corresponding groove (not shown) in part 15*b*. The lower edge 27 of lid 17 is receivable within the combined horizontal grooves 29*a* and 29*b*. Note that a grasping ledge 31 depends outwardly from the lower region of lid 17, and serves to facilitate manipulation of the lid. The halves 15*a* and 15*b* are bonded together using a suitable bonding agent or other techniques well known in the plastics industry.

FIGS. 2, 3 and 4 show that in the assembled device the lid 17 can have a closed position in which a lower portion of lid 17 completely covers the storage compartment access way 51. As FIG. 5 shows, the length of lid 17 is selected so that it may be secured in its closed position with the locking of padlock 13, since the upper end of lid 17 will abut the shackle leg 33 at juncture 53, preventing any upward movement of the lid. When the padlock is unlocked as in FIG. 4, the leg 33 is withdrawn from hole 37 which allows lid 17 to be slid upwardly to uncover access way 51. Note that while the lid is in this open position the padlock cannot be locked because lid 17 will obstruct the passage of leg 33 through opening 37.

Note that while a rotary combination padlock 13 is shown in use with the invention, it should be apparent that the inventive concept is adaptable for use with other types of conventional padlocks. Various other modifications and advantages of the above described embodiments will be apparent to those skilled in the art and may be made without departing from the spirit and scope of the invention.

What is claimed is:

1. Cover in combination with a padlock, which padlock has a case and a U-shaped shackle mounted thereto, a first leg of said shackle being releasably received in said case, said cover including:

(a) first portion for enclosing and mounting said case having spaced apart openings for passing the legs of said shackle, said first shackle leg being receivable in a first of said openings;

(b) second portion adjacent said first portion and having spaced apart walls that define a storage compartment, one compartment wall having an access opening therein; and (c) flexible, resilient, elongated lid member mounted to guide means in said cover for slidable movement therealong, said guide means extending from said compartment opening and past said first shackle leg opening, said lid having a closed position in which it is lockable when said first shackle leg is locked within said case, and in which closed position, a first end portion of said lid member covers said compartment opening and a second end of said lid member abuts said first shackle leg to prevent sliding of said lid member, said lid member being slidable to an open position when said first shackle leg is unlocked and withdrawn from said case, in which open position the second end of said lid member is slidable beyond said first shackle leg opening and said first end portion uncovers said compartment opening.

2. Cover as defined in claim 1 in which said padlock is a combination lock with a rotary combination dial, and said first portion has an opening that surrounds said dial.

3. Cover as defined in claim 1 in which said padlock case is circular and said first compartment is above said second compartment and has a curved upper wall containing said shackle leg openings.

4. Cover as defined in claim 1 wherein said guide means includes grooves which receive edge portions of said lid member.

5. Cover as defined in claim 2 wherein said guide means has an upper portion which follows a curved path.

6. Cover as defined in claim 4 wherein the grooved portion of said guide means extends generally in a straight path, said guide means having an ungrooved curved portion that is provided by the inner surface of a curved wall of said first compartment.

7. Cover as defined in claim 1 wherein a second leg of said shackle intercepts the path of said guide means.

* * * * *